US006038713A

United States Patent [19]

Grosse

[11] Patent Number: 6,038,713

[45] Date of Patent: Mar. 21, 2000

[54] BACK REST

[76] Inventor: Neil O. Grosse, 238 Glen Park Avenue, Toronto, Ontario, Canada, M6B 2E3

[21] Appl. No.: 09/137,044

[22] Filed: Aug. 20, 1998

[51] Int. Cl.[7] ..... A47K 3/12

[52] U.S. Cl. ..... 4/575.1; 4/573.1

[58] Field of Search ..... 4/573.1, 575.1, 4/578.1, 579

[56] References Cited

U.S. PATENT DOCUMENTS 2,200,247 5/1940 Haas ..... 4/575.1

2,825,069 3/1958 Jorgensen et al. ..... 4/575.1

3,583,000 6/1971 Matkea ..... 4/575.1

*Primary Examiner*—Robert M. Fetsuga

[57] ABSTRACT

A back rest for mounting to a bath tub. The back rest includes a pair of spaced apart elongate side rods with a back rest member extending between the side rods. The top end of the back rest member is extended towards the upper ends of the side rods while the bottom end of the back rest member is extended towards the lower ends of the side rods. Coupled to each end of the side rods is an attachment member for attaching to a surface, such as the surface of a bath tub or a wall.

1 Claim, 4 Drawing Sheets

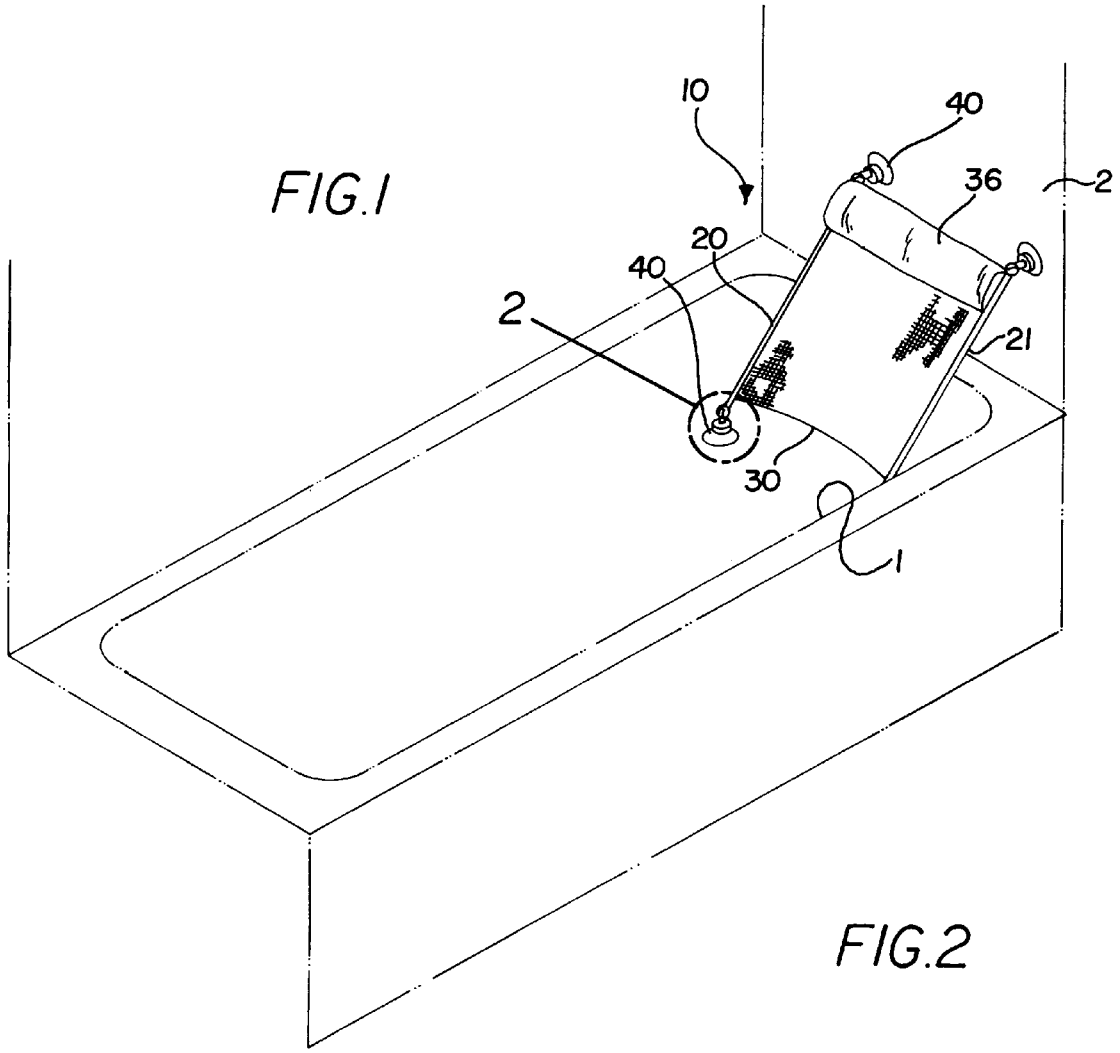
FIG.2
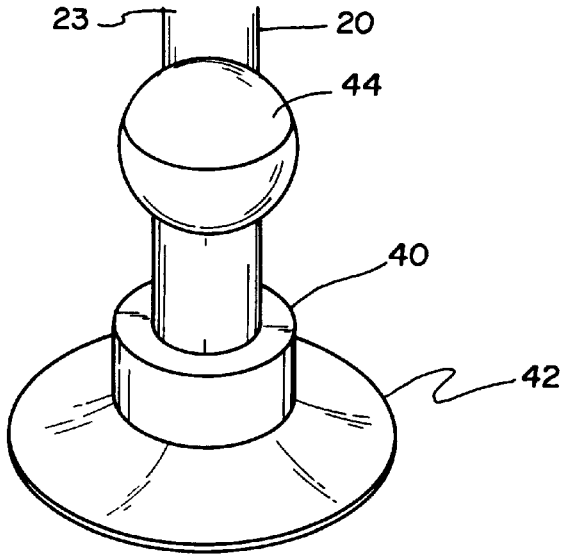

BACK REST

BACKGROUND OF THE INVENTION

1. Field of the Invention

The present invention relates to bath tub devices and more particularly pertains to a new back rest for mounting to a bath tub.

2. Description of the Prior Art

The use of bath tub devices is known in the prior art. More specifically, bath tub devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art bath tub devices include U.S. Pat. No. 5,341,525; U.S. Pat. No. 4,389,740; U.S. Pat. No. 4,955,093; U.S. Pat. No. 4,230,364; U.S. Pat. No. Des. 335,036; and U.S. Pat. No. 5,157,795.

While these devices fulfill their respective, particular objectives and requirements, the aforementioned patents do not disclose a new back rest. The inventive device includes a pair of spaced apart elongate side rods with a back rest member extending between the side rods. The top end of the back rest member is extended towards the upper ends of the side rods while the bottom end of the back rest member is extended towards the lower ends of the side rods. Coupled to each end of the side rods is an attachment member for attaching to a surface, such as the surface of a bath tub or a wall.

In these respects, the back rest according to the present invention substantially departs from the conventional concepts and designs of the prior art, and in so doing provides an apparatus primarily developed for the purpose of mounting to a bath tub.

SUMMARY OF THE INVENTION

In view of the foregoing disadvantages inherent in the known types of bath tub devices now present in the prior art, the present invention provides a new back rest construction wherein the same can be utilized for mounting to a bath tub.

The general purpose of the present invention, which will be described subsequently in greater detail, is to provide a new back rest apparatus and method which has many of the advantages of the bath tub devices mentioned heretofore and many novel features that result in a new back rest which is not anticipated, rendered obvious, suggested, or even implied by any of the prior art bath tub devices, either alone or in any combination thereof.

To attain this, the present invention generally comprises a pair of spaced apart elongate side rods with a back rest member extending between the side rods. The top end of the back rest member is extended towards the upper ends of the side rods while the bottom end of the back rest member is extended towards the lower ends of the side rods. Coupled to each end of the side rods is an attachment member for attaching to a surface, such as the surface of a bath tub or a wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new back rest apparatus and method which has many of the advantages of the bath tub devices mentioned heretofore and many novel features that result in a new back rest which is not anticipated, rendered obvious, suggested, or even implied by any of the prior art bath tub devices, either alone or in any combination thereof.

It is another object of the present invention to provide a new back rest which may be easily and efficiently manufactured and marketed.

It is a further object of the present invention to provide a new back rest which is of a durable and reliable construction.

An even further object of the present invention is to provide a new back rest which is susceptible of a low cost of manufacture with regard to both materials and labor, and which accordingly is then susceptible of low prices of sale to the consuming public, thereby making such back rest economically available to the buying public.

Still yet another object of the present invention is to provide a new back rest which provides in the apparatus and methods of the prior art some of the advantages thereof, while simultaneously overcoming some of the disadvantages normally associated therewith.

Still another object of the present invention is to provide a new back rest for mounting to a bath tub.

Yet another object of the present invention is to provide a new back rest which includes a pair of spaced apart elongate side rods with a back rest member extending between the side rods. The top end of the back rest member is extended towards the upper ends of the side rods while the bottom end of the back rest member is extended towards the lower ends of the side rods. Coupled to each end of the side rods is an attachment member for attaching to a surface, such as the surface of a bath tub or a wall.

Still yet another object of the present invention is to provide a new back rest that allows a bather to rest their back in a more comfortable position while sitting or lying in a tub.

Even still another object of the present invention is to provide a new back rest that is adjustably mountable to a bath tub so that the back rest can be positioned in a variety of angles for ideal positioning by a bather.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new back rest in use according to the present invention.

FIG. 2 is a schematic partial perspective view of an attachment member of the present invention taken from circle 2 on FIG. 1.

DESCRIPTION OF THE PREFERRED EMBODIMENT

Figure 3:
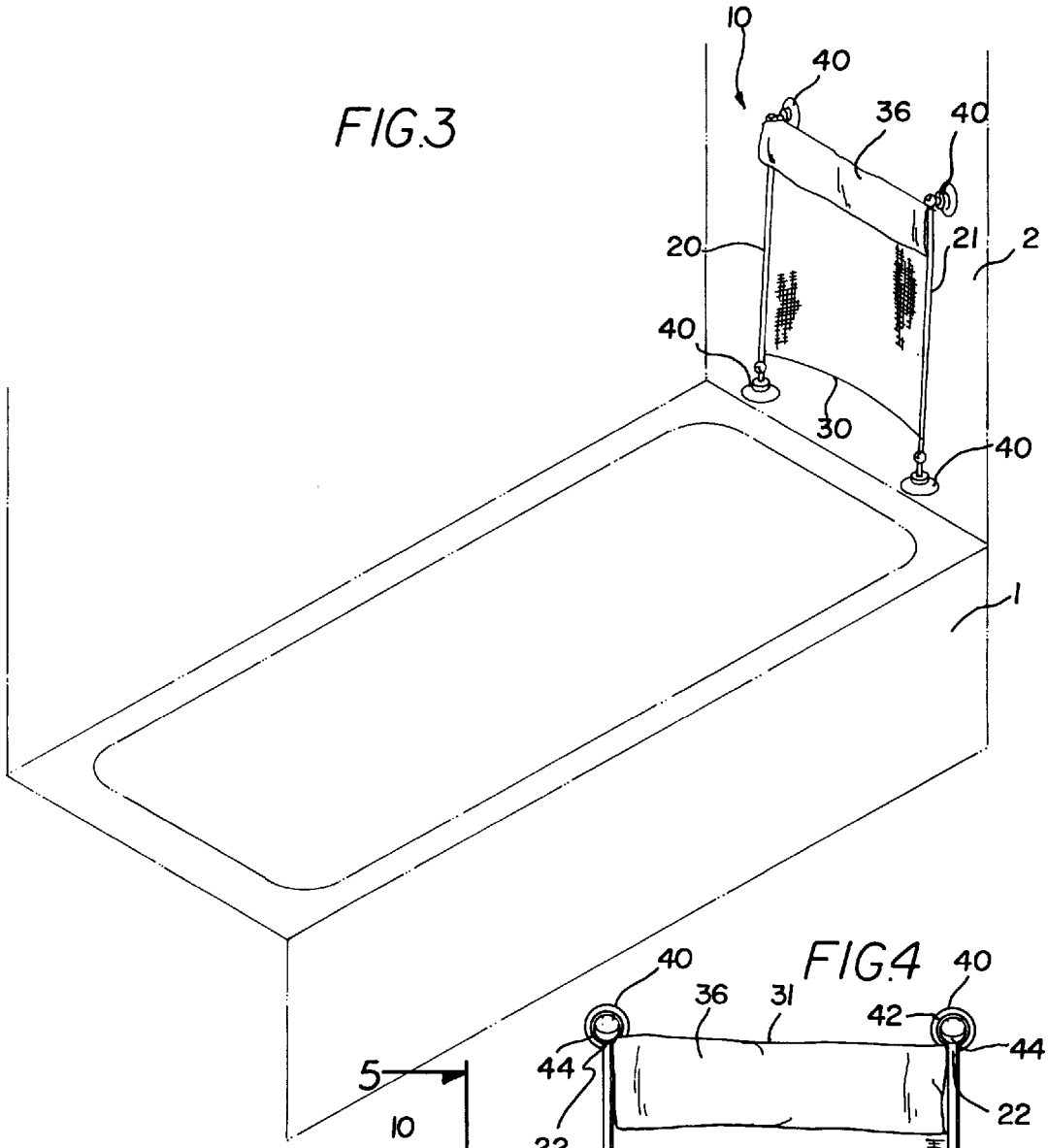
FIG. 3 is a schematic perspective view of the present invention suspended above a bath tub while not in use for convenient storage.

With reference now to the drawings, and in particular to FIGS. 1 through 7 thereof, a new back rest embodying the principles and concepts of the present invention and generally designated by the reference numeral 10 will be described.

As best illustrated in FIGS. 1 through 7, the back rest 10 generally comprises a pair of spaced apart elongate side rods 20,21 with a back rest member 30 extending between the side rods 20,21. The elongate side rods 20, 21 are straight between the upper and lower ends (see FIGS. 1, 3, 6 and 7). The top end 31 of the back rest member 30 is extended towards the upper ends 22 of the side rods 20,21 while the bottom end 32 of the back rest member 30 is extended towards the lower ends 23 of the side rods 20,21. Coupled to each end 22,23 of the side rods 20,21 is an attachment member 40 for attaching to a surface, such as the surface of a bath tub 1 or a wall 2.

Figure 4:
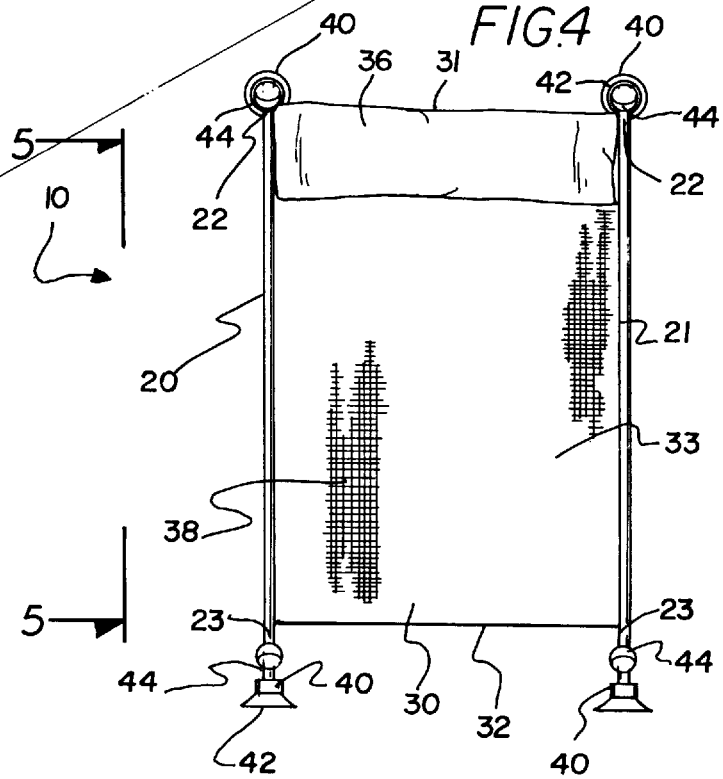
FIG. 4 is a schematic front side view of the present invention.
Figure 5:
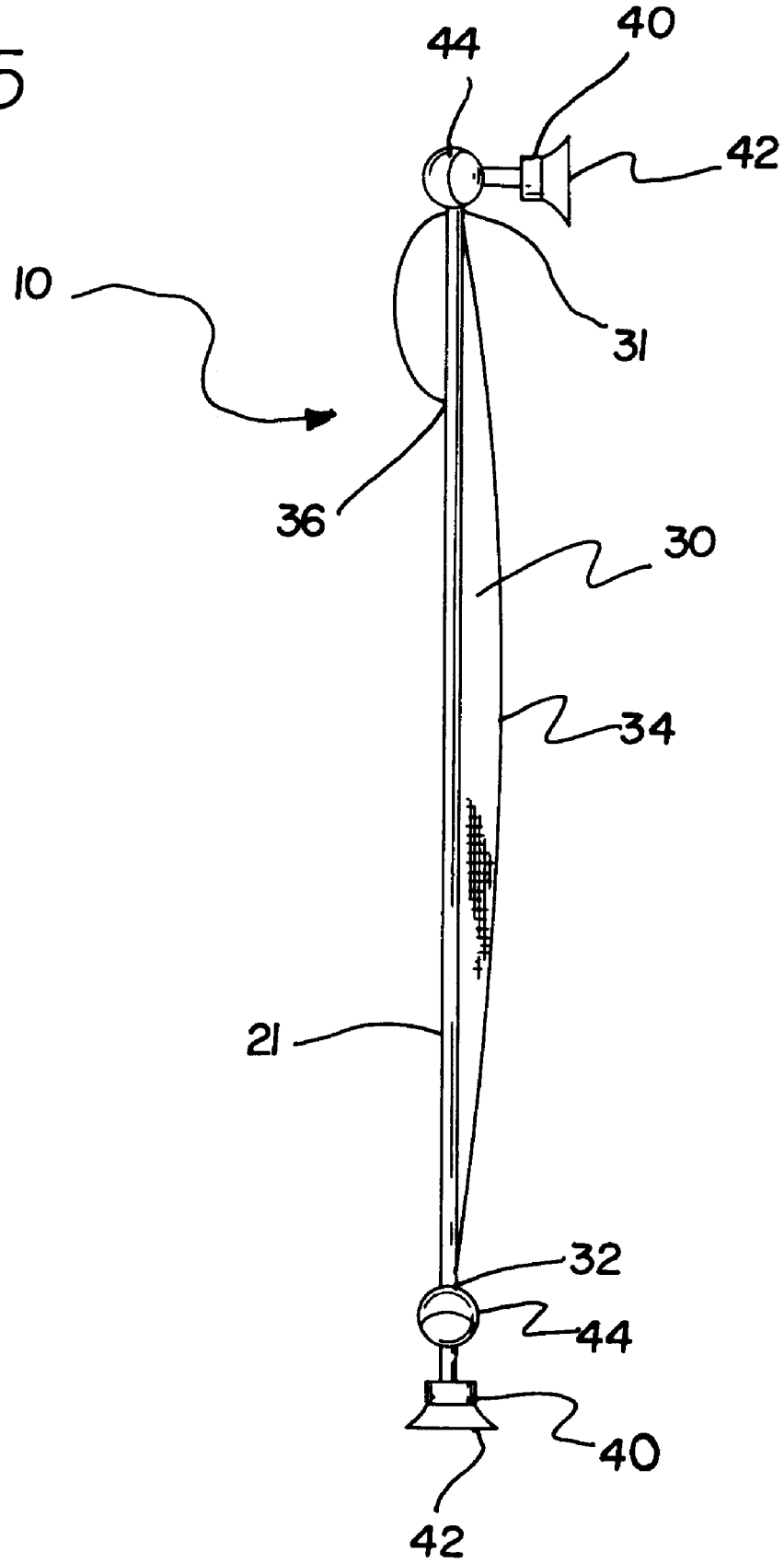
FIG. 5 is a schematic side view of the present invention taken from line 5—5 on FIG. 4.

As illustrated in FIG. 4, the back rest 10 includes a pair of spaced apart elongate supporting side rods 20,21 each having upper and lower ends 22,23. The back rest member extends between the side rods 20,21 with the top end 31 of the back rest member 30 extending towards the upper ends 22 of the side rods 20,21 and the bottom end 32 of the back rest member 30 extending towards the lower ends 23 of the side rods 20,21. The front surface 33 of the back rest member 30 is designed for resting a bathers back thereon. Preferably, the front and back surfaces 33,34 of the back rest member 30 are curved between the side rods 20,21 for providing additional comfort to a bather resting their back thereon.

Also preferably, a head rest cushion 36 for comfortably resting a head of a bather thereon is coupled to the back rest member 30. The head rest cushion 36 is positioned towards the top end 31 of the back rest member 30 and ideally extends between the side rods 20,21.

With reference to FIG. 4, the back rest member 30 has a plurality of apertures 38 extending between the front and back surfaces 33,34 of the back rest member 30. The apertures 38 are designed for permitting fluid to pass through the back rest member 30. This helps prevent a bather's back from becoming suctioned or stuck to the back rest member, especially when wet.

As illustrated in FIG. 2, each end 22,23 of the side rods 20,21 has an attachment member 40 coupled to it. Preferably, each of the attachment members 40 includes a suction cup member 42 for detachably mounting to a surface, such as a bathtub surface 1 or a wall 2. In a preferred embodiment, the attachment members 40 are coupled to their respective end 22,23 of the side rods 20,21 by a ball and socket joint 44 so that the attachment members 40 may be ideally mounted to any angled surface 1,2.

In use, the back rest 10 is designed for convenient mounting to a bath tub 1 and an adjacent wall 2, however, the back rest 10 may be used for a back rest support in other environments. As shown in FIG. 1, he back rest 10 may be mounted in use with the suction cup members 42 of the attachment members 40 on the upper ends 23 of the side rods 20,21 mounted to a wall 2 adjacent the bath tub 1 with the suction cups 42 of the attachment members 40 at the lower ends 23 of the side rods 20,21 attached to the bath tub surface 1. When not in use, the upper attachment members may be mounted higher up on the wall 2 with the lower attachment members hanging above the bath tub 1 as illustrated in FIG. 3.

Figure 6:
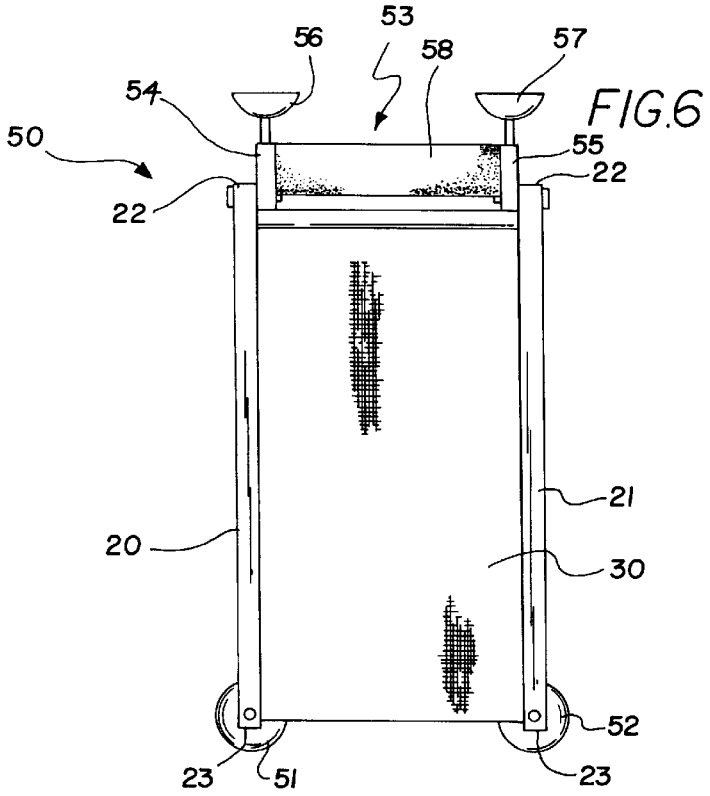
FIG. 6 is a schematic front side view of an optional preferred embodiment of the present invention.
Figure 7:
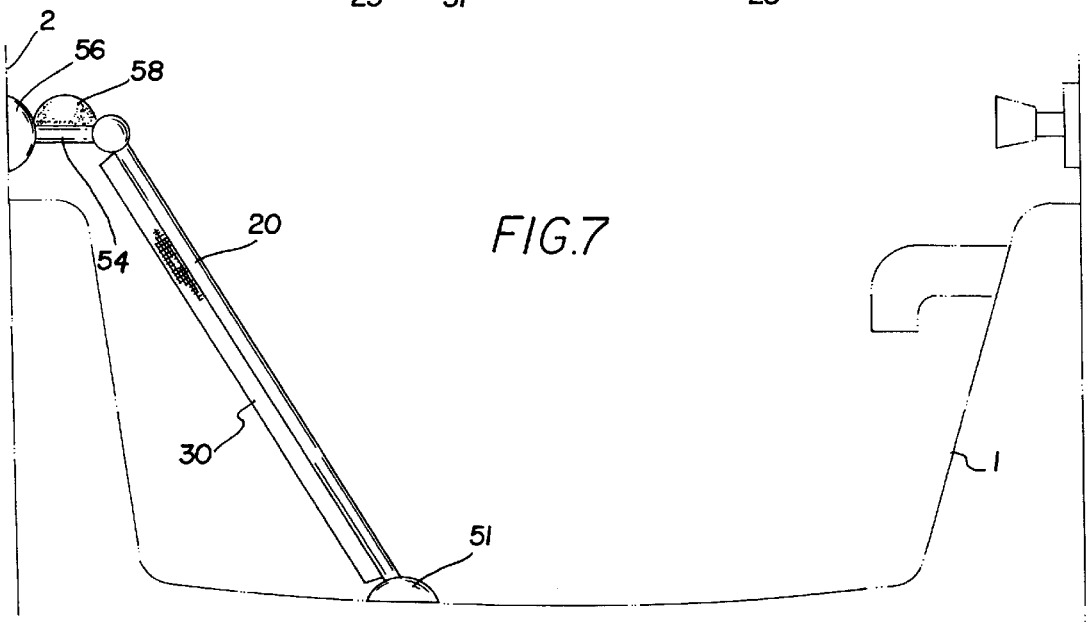
FIG. 7 is a schematic side view of the optional preferred embodiment of the present invention of FIG. 6 in use in a bathtub.

FIGS. 6 and 7 illustrate an optional preferred embodiment of the back rest device 10. In this embodiment the lower ends 23 of the side rods 20,21 each have a lower suction cup 51,52 coupled directly thereto. In use, the lower suction cups 51,52 of the lower ends of the side rods are designed for suctional attachment to the bottom of a bathtub. A head rest 53 is extended between the upper ends 22 of the side rods 20,21 and is pivotally coupled to the upper ends of the side rods. The head rest 53 includes a pair of spaced apart side frames 54,55 and a cushion 58 extending between the side frames. One of the side frames 54 is positioned adjacent one of the side rods 20 and the other side frame 55 is positioned adjacent the other side rod 21. A pair of upper suction cups 56,57 are coupled to the head rest with one of the upper suction cups positioned adjacent one of the side frames and the other upper suction cup positioned adjacent the other side frame. In use, the head rest 53 is pivotable to permit suctional attachment of the upper suction cups 56,57 to the side of the bathtub 1 or to a wall 2 adjacent the bathtub.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A back rest device, comprising:

a pair of spaced apart elongate side rods each having upper and lower ends;

a back rest member having front and back surfaces, and top bottom ends, said back rest member being extended between said side rods, said top end of said back rest member being extended towards said upper ends of said side rods, said bottom end of said back rest member being extended towards said lower ends of said side rods;

wherein said back rest member is curved between said side rods;

wherein said back rest member has a plurality of apertures extending between said front and back surfaces of said back rest member, said apertures being for permitting fluid to pass through;

said lower ends of said side rods each having a lower suction cup coupled thereto;

a head rest being extended between said side rods, said head rest being pivotally coupled to said upper ends of said side rods, said head rest including a pair of spaced apart side frames and a cushion extending between said side frames, one of said side frames being positioned adjacent one of said side rods, another of said side frames being positioned adjacent another of said side rods; and a pair of upper suction cups being coupled to said head rest, one of said upper suction cups being positioned adjacent one of said side frames, another of said upper suction cups being positioned adjacent another of said side frames.

* * * * *